United States Patent [19]

Rousseau

[11] Patent Number: 5,057,828

[45] Date of Patent: Oct. 15, 1991

[54] DISPLAY DEVICE COMPRISING ROTATING DISPLAY ELEMENTS HAVING A PLURALITY OF FACES, AND DISPLAY PANEL COMPOSED OF SUCH DEVICES

[76] Inventor: Jacques Rousseau, 22, Chemin du Golf, 76200 Dieppe, France

[21] Appl. No.: 419,614

[22] Filed: Oct. 10, 1989

[30] Foreign Application Priority Data

Oct. 12, 1988 [FR] France ..... 88 13433

[51] Int. Cl.[5] ..... G09G 3/16

[52] U.S. Cl. ..... 340/764; 340/815.27; 340/815.26; 40/449; 116/204

[58] Field of Search ..... 340/764, 783, 815.27, 340/815.26, 815.05, 815.09; 40/447, 449, 451, 452; 116/204

[56] References Cited

U.S. PATENT DOCUMENTS

| | | | |
|---|---|---|---|
| 3,109,168 | 10/1963 | Abendroth | 340/764 |
| 3,706,148 | 12/1972 | Johnston | 40/447 |
| 4,264,906 | 4/1981 | Wakatake | 40/447 |
| 4,417,241 | 11/1983 | Wakatake | 340/764 |
| 4,597,209 | 7/1986 | Hukill | 40/447 |
| 4,761,905 | 8/1988 | Black | 340/764 |
| 4,811,008 | 3/1989 | Woolfolk | 340/764 |

FOREIGN PATENT DOCUMENTS 2610438 5/1988 France .

*Primary Examiner*—Alvin E. Oberley
*Assistant Examiner*—Xiao Min Wu
*Attorney, Agent, or Firm*—Mason, Fenwick & Lawrence

[57] ABSTRACT

Display device comprising an array of rotating display elements (4) which have at least two faces of different color and are arranged in rows and columns, means (8, 18) for actuating the said rotating elements in terms of rotation, intended to ensure the modification of the face of each rotating element appearing on the display, and means for controlling the actuating means (8, 18) so as to ensure the rotation of the said rotating elements in order to form an image to be displayed, characterized in that the rotating elements (4) of each row or column are arranged on a common shaft rotatably mounted in a frame of the device, each rotating element being connected to the shaft by a friction coupling, a device (8, 15) for driving in step-by-step rotation associated with each shaft and a retractable member (16) for blocking all the rotating elements (4) of each column or row in terms of rotation, one actuating device (18) being associated with each blocking member (16).

16 Claims, 6 Drawing Sheets

DISPLAY DEVICE COMPRISING ROTATING DISPLAY ELEMENTS HAVING A PLURALITY OF FACES, AND DISPLAY PANEL COMPOSED OF SUCH DEVICES

The present invention relates to display devices consisting of a matrix of rotating elements which have a plurality of faces, are arranged in rows and columns and define a display plane on which an image is formed by a specific arrangement of faces, of various colours, of various rotating elements.

Known display devices of this type generally comprise, for each rotating element mounted so as to rotate about a fixed axle, an independent actuating device, the control of the actuating devices being ensured by a management device as a function of the previously displayed image and of the new image to be displayed, for example by a line-by-line scanning process of the control devices.

Such a technique, which calls for as many actuating devices as there are display elements, leads to the production of display devices which are heavy and costly and which, moreover, require considerable electrical power.

Furthermore, the large number of actuating devices makes such a known display device difficult to repair on account of the lack of accessibility to its components.

There are also known display devices having rotating elements in which the rotating elements are mounted so as to rotate about fixed axles which pass through them with play via orifices having, in cross-section, a profile defining stable positions of the rotating elements corresponding respectively to the presentation of specific faces of the said elements on the display.

In these devices, the rotating elements are actuated in such a way that they are caused to pass from one stable position to another.

However, the disadvantage of display devices of this type lies in the fact that the rotating elements, on account of their connection with play to their axle, may undergo inopportune changes of position under the action of external phenomena such as the wind.

The invention aims to overcome the disadvantages of display devices of the prior art by creating a display device which, on account of its relatively simple design, has a reduced weight which makes it easier to handle during its installation or its removal for repairs, and which is of lower cost price than the conventional devices, allowing it a wider range of applications It also aims to provide such a display device, the energy consumption of which is reduced compared to that of conventional display devices.

It thus relates to a display device comprising an array of rotating display elements which have at least two faces of different colour and are arranged in rows and columns, means for actuating the said rotating elements in terms of rotation, intended to ensure the modification of the face of each rotating element appearing on the display, and means for controlling the actuating means so as to ensure the rotation of the said rotating elements in order to form an image to be displayed, characterized in that the rotating elements of each row or column are arranged on a common shaft rotatably mounted in a frame of the device, each rotating element being connected to the shaft by a friction coupling, a device for driving in step-by-step rotation associated with each shaft and a retractable member for blocking all the rotating elements of each column or row in terms of rotation, one actuating device being associated with each blocking member.

The invention will be better understood with the aid of the description which follows, given purely by way of example and making reference to the accompanying drawings, in which.

Figure 1:
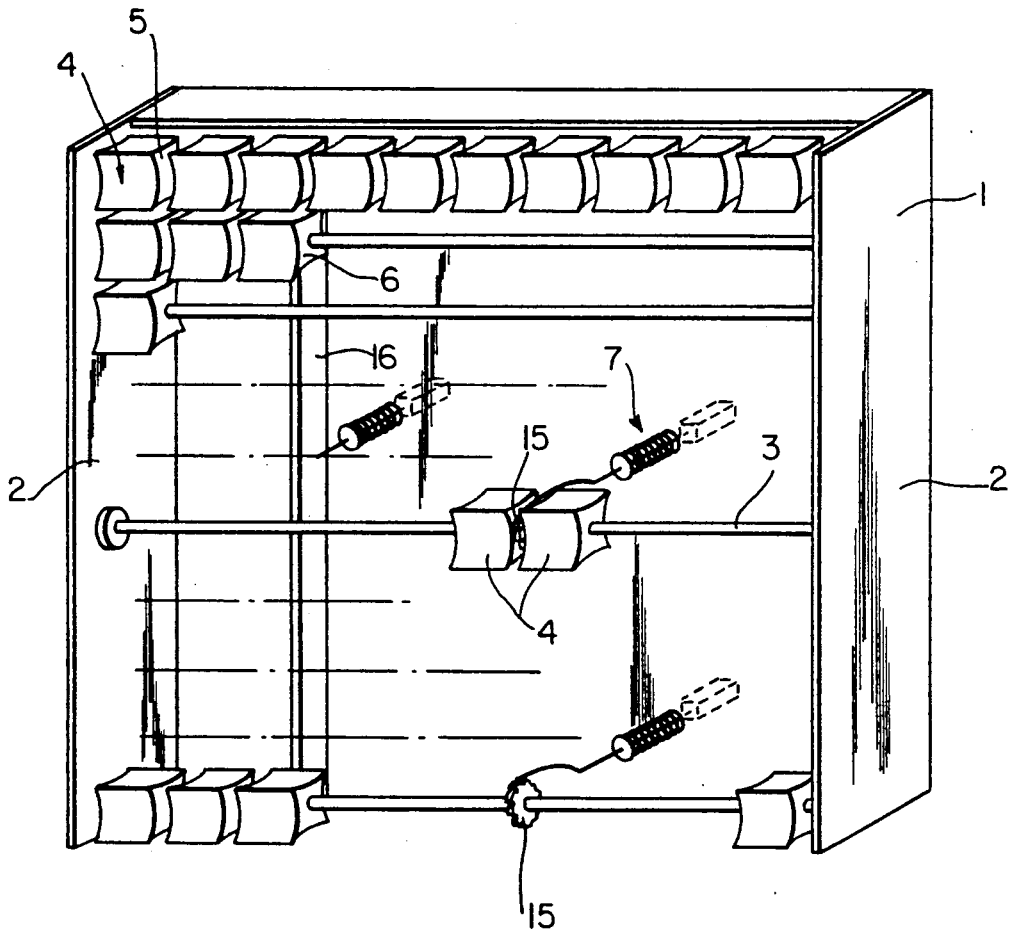
FIG. 1 is a diagrammatic perspective view of a modular display device according to the invention.
Figure 3:
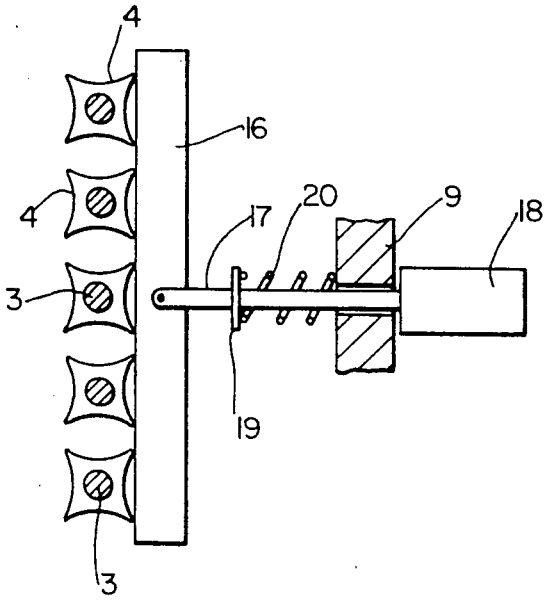
FIG. 3 is a cross-sectional view showing the construction of a member for blocking the display elements of one column of the device of FIG. 1, in the blocking position.
Figure 4:
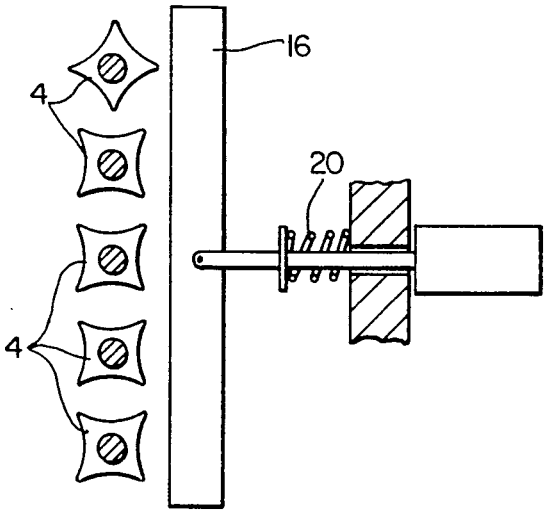
FIG. 4 is a view similar to that of FIG. 3 showing the blocking member in the release position.
Figure 4A:
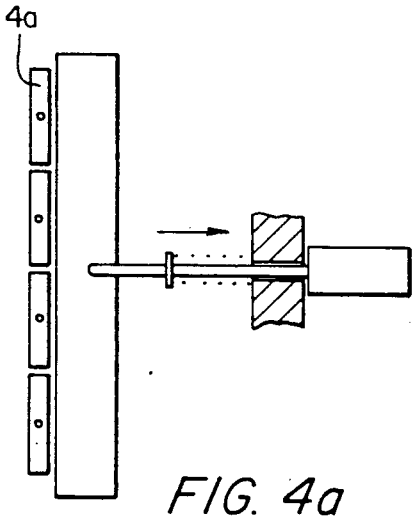
Figure 4B:
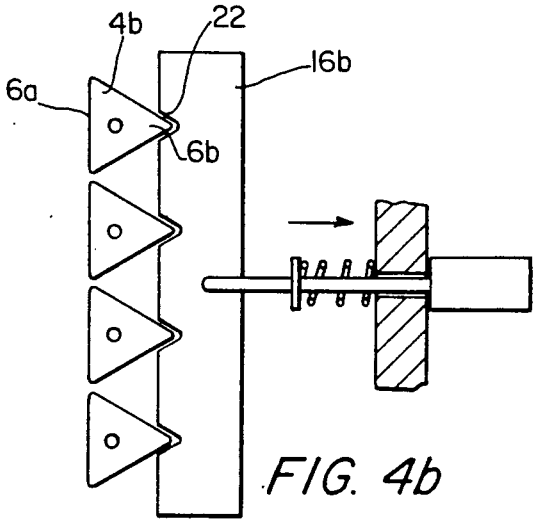
Figure 5A:
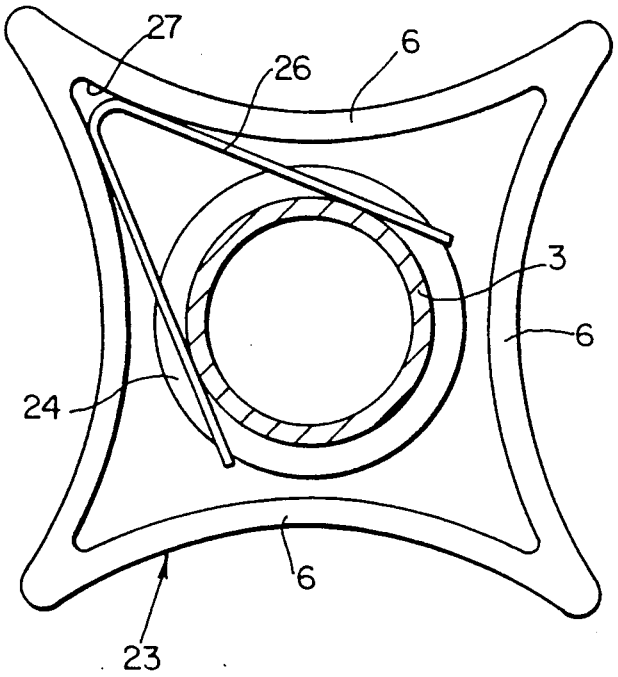
Figure 5B:
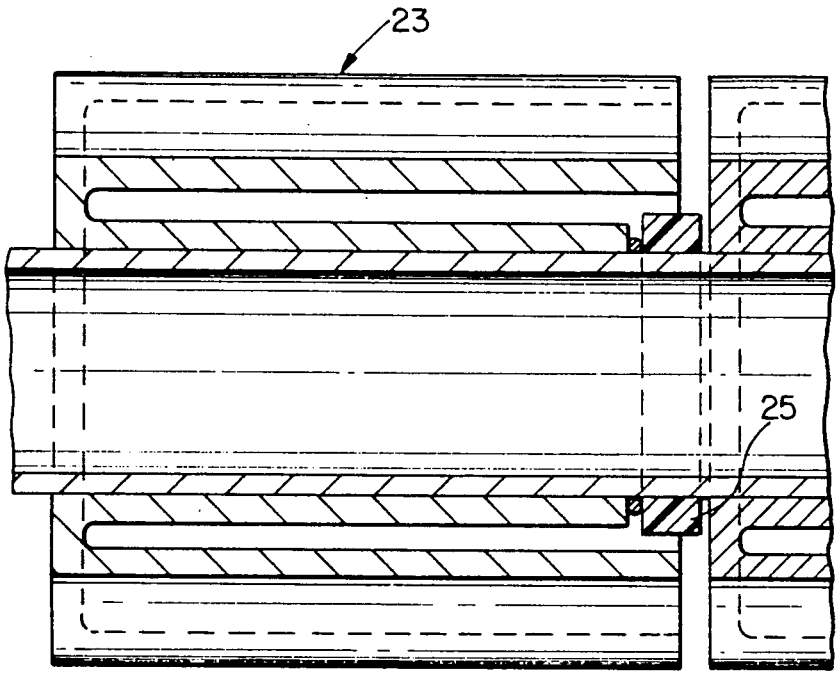
Figure 6:
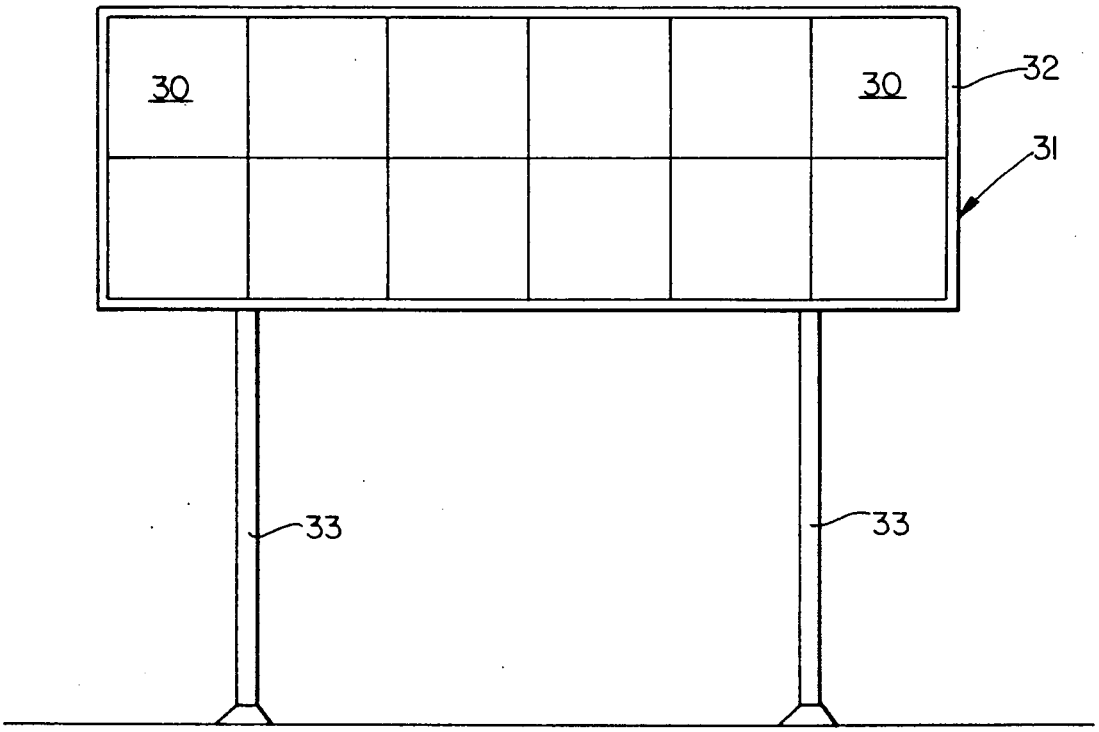
Figure 7:
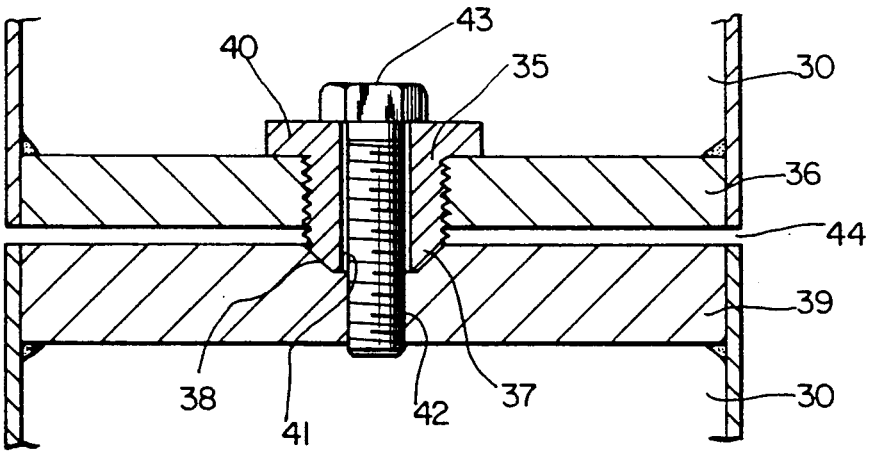
Figure 8:
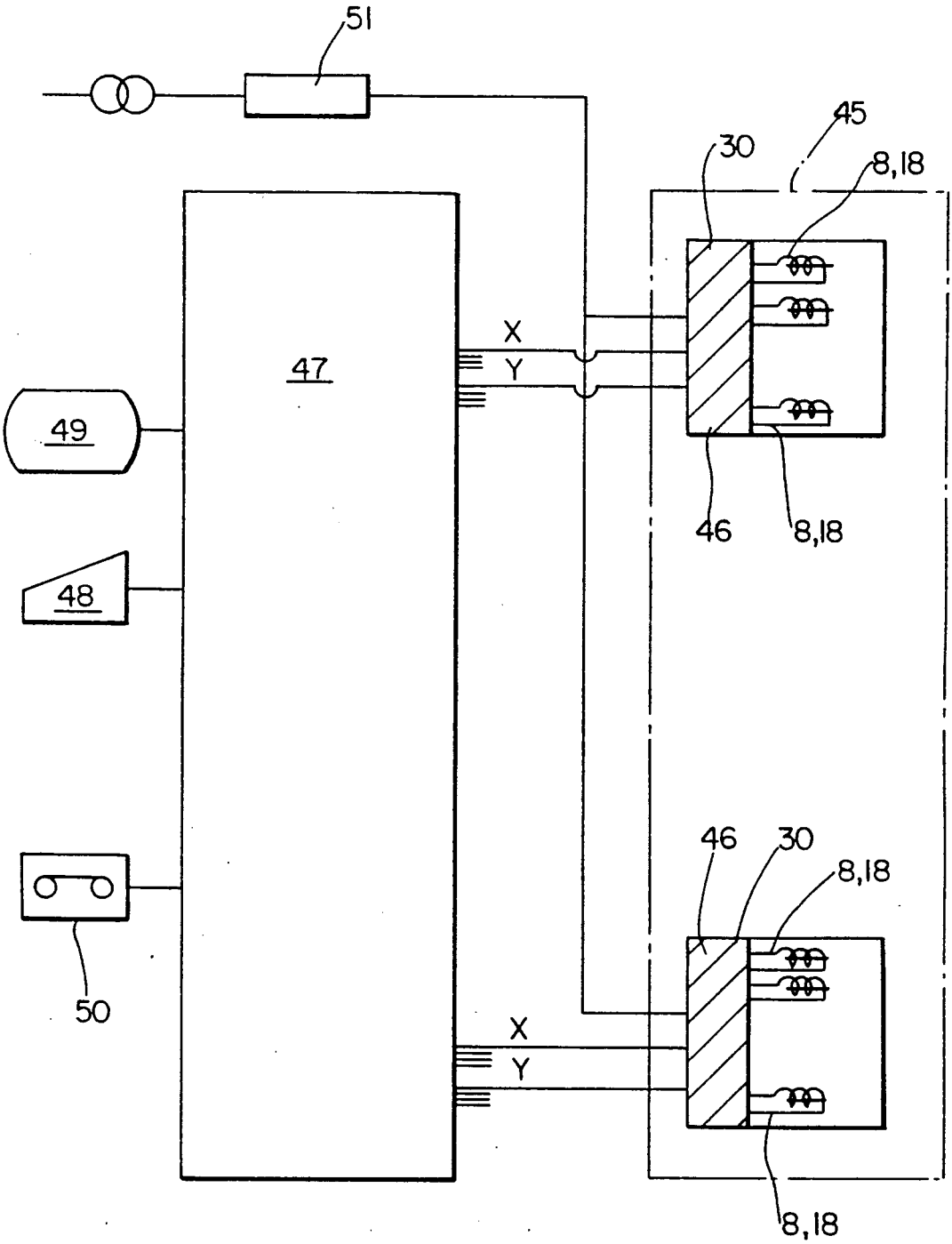
Figure 9:
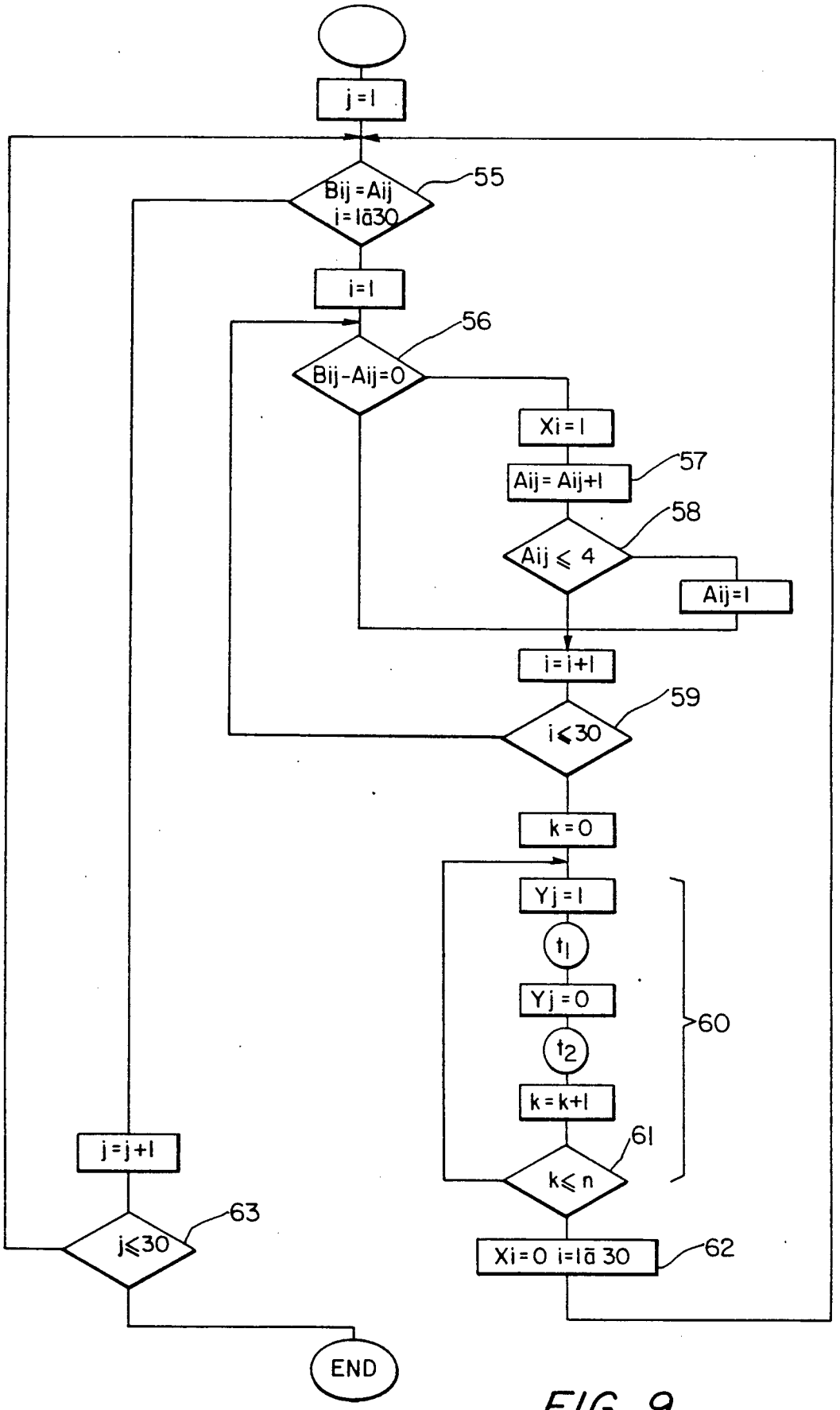

FIGS. 4*a* and 4*b* are views similar to FIG. 3 showing variants of display elements;

FIGS. 5*a* and 5*b* cross-sectional and longitudinal views of a display element and means for frictionally connecting this element to its supporting shaft;

FIG. 6 is a front view of a display panel consisting of a plurality of modular devices shown in FIG. 1;

FIG. 7 is a cross-sectional view of means for mechanically coupling 2 modular devices to one another;

FIG. 8 is a wiring diagram of the control circuit of the actuating devices of a panel composed of a plurality of modular display devices according to the invention; and FIG. 9 is a flow chart illustrating the operation of the display device according to the invention.

FIG. 1 is a diagrammatic representation of a display device comprising a housing or frame 1 within the vertical lateral walls 2 of which there are rotatably mounted shafts 3 each carrying a row of display elements 4 connected to their shaft by frictional connecting means which will be described below with reference to FIGS. 5*a* and 5*b*.

The display elements 4 each have a plurality of faces of different colour.

In the present example, the display elements 4 consist of cubes having concave lateral faces 5. The elements 4 additionally have end faces 6 which are perpendicular to their lateral face and through which their supporting shaft 3 passes.

The modular device of FIG. 1 is composed of an array of display elements 4 comprising rows of L cubes each carried by a shaft 3, the number of rows arranged according to the height of the device being equal to H.

Associated with each of the supporting shafts 3 of one row of display elements 4 is a driving device designated by the general reference numeral 7.

Figure 2:
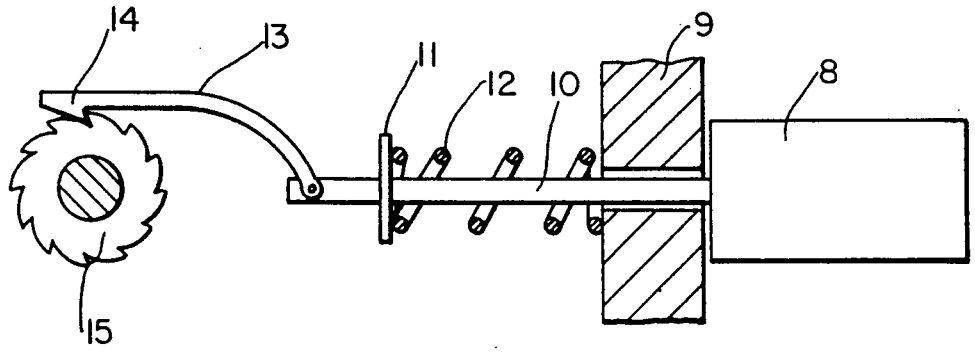
FIG. 2 is a cross-sectional view, on a larger scale, of a device for driving a shaft carrying a row of display elements of the device of FIG. 1.

As shown in greater detail in FIG. 2, this driving device essentially comprises an electromagnet 8 of the attracting type, which is fixed on a support 9 integral with the housing 1 and provided with a rod 10 passing through the support and carrying in the proximity of its free end a washer 11, between which washer 11 and the wall 9 there is arranged a helical return spring 12 surrounding the rod 10. Articulated to the free end of the rod 10 is an arm 13 provided with a pawl 14 cooperating with a ratchet wheel 15 fixed on the corresponding supporting shaft 3 and arranged between two adjacent display elements 4.

In the present example, in which the display elements 4 each comprise four lateral faces of different colour, the passage from one display face of one colour to an adjacent face of a different colour requires the rotation of the corresponding display element through a quarter turn.

The number of teeth of the ratchet wheel 15 is therefore chosen so as to be equal to a multiple of four so that the rotation through a quarter turn can be ensured by a constant number of reciprocating movements of the electromagnet and, consequently, of the pawl arm 13.

Referring once again to FIG. 1, it can be seen that the modular display device according to the invention additionally comprises members 16 for blocking the display elements arranged in columns in terms of rotation, the number of these columns 16 being equal to the number L of display elements 4 per row.

As shown in FIG. 3, each blocking member consists of a vertical bar 16 articulated at its centre to the end of a rod 17 actuated by an electromagnet 18 fixed on the support 9 of the electromagnets 8 for driving the supporting shafts 3. A washer 19 is mounted on the rod 17, between which washer 19 and the supporting wall 9 there is arranged a helical return spring 20 surrounding the rod 17.

In its position shown in FIG. 3, the blocking bar 16 is placed in the position for blocking the column of corresponding display elements 4. It is, in fact, in contact with the faces of the display elements opposite those which appear on the display surface of the device.

In its position shown in FIG. 4, the blocking bar 16 is situated in the retracted position under the action of a displacement ensured by the electromagnet 18 counter to the action of the return spring 20.

The display elements 4 of the corresponding column can then rotate freely under the action of the setting into rotation of their supporting shaft 3. It can, moreover, be seen in FIG. 4, that the upper display element is in the process of being displaced.

In FIG. 4*a*, a variant of the display device according to the invention is shown, in which the display elements consist of blades 4*a* having two opposite faces of different colour. The revolving of the display elements in the form of blades of this type requires a rotation through 180°.

In other respects, the device of FIG. 4*a* is similar to that described with reference to FIGS. 1 to 4.

In the variant of the display device according to the invention shown in FIG. 4*b*, the display elements 4*b* consist of prismatic blocks of equilateral triangle cross-section. In such an arrangement, the replacement of a face of a certain colour by an adjacent face of a different colour requires a rotation of the corresponding element through an angle of 120°. When the vertex 6*b* of the element is situated opposite its display face 6*a*, it is then facing the corresponding blocking bar 16*b*.

So as to permit this bar to ensure the immobilization of the prismatic display elements 4*b* in terms of rotation, the said bar has notches 22 in which the vertices 6*b* of the elements 4*b* are engaged when the bar 16*b* is in the blocking position.

In other respects, the display device shown in FIG. 4*b* is of similar construction to that of the display devices described above.

In FIGS. 5*a* and 5*b*, a display element of the device of FIG. 1 is shown in greater detail, as well as its method of connection to its support shaft.

This display element is a moulded part, made of plastic, comprising an outer lateral surface having four concave sides delimiting as many display faces 6 of different colour and an inner hub 24 made in one piece with the outer surface and via which the display element is mounted on its supporting shaft 3 which, in the present example, consists of a tubular part. The length of the hub 24 is slightly less than the length of the lateral surface 23 so as to form, with the end of the lateral surface opposite its end for connection to the hub, a seating for a ring 25 (FIG. 5*b* ) mounted on the shaft 3, between which ring 25 and the end of the hub 24 a kickover spring 26 is mounted, the branches of which grip the shaft 3 and the vertex of which is accommodated in a corner 27 of the cavity defined by the walls, turned towards one another, of the outer lateral surface 23 and of the hub 24.

It can be seen that, by virtue of such an arrangement, the display element 4 is connected to the shaft 3 so as to be able to rotate with the latter when it is not blocked by the corresponding blocking bar 16 (FIG. 4) and to be able to rotate relative to the shaft 3 when the blocking bar 16 is in contact with one of its display faces 6 (FIG. 3).

The connection between each display element and its supporting shaft 3 is therefore a frictional connection.

A modular display device of the type described above may be combined, by juxtaposition, with other identical modular display devices to form a display panel of large dimensions.

FIG. 6 shows an example of a display device consisting of 12 modular display devices 30 arranged in a structure 31 comprising a frame 3 and uprights 33 forming legs.

It will therefore be understood that, by joining together an appropriate number of modular display devices 30, it is possible to produce display panels with as large a surface as is desired.

It is, for example, possible to construct a display panel occupying almost an entire wall of a building or the like.

In FIG. 7, means for removably connecting two modular display devices 30 to one another are shown. These connecting means essentially comprise a retractable positioning member 35 consisting of an externally threaded bush mounted in one of the walls 36 of the housing 1 of a modular display device and provided with a frustoconical end 37 engaged in a corresponding seating 38 formed in the lateral wall 39 of an adjacent modular display device, which lateral wall 39 is situated facing the wall 36. The part 35 is provided, at its end opposite its frustoconical part 37, with a hexagonal collar 40 intended to permit the screwing of the part 35 into the wall 36 of the modular display device to which it is connected.

Passing through the part 35 is a bore 41 coaxial with a threaded hole 42 formed in the lateral wall 39 of the adjacent modular display device. A locking screw 43 passing through the part 35 is screwed into the threaded hole 42 to ensure the fixing of the two modular display devices to one another. The length of the cylindrical portion of the part 35 is greater than the thickness of the wall 36, so that when the part 35 is in place there remains a clearance 44 between the mutually facing walls 36 and 39 of the two adjacent modular display devices, thereby facilitating the handling of a modular device during its installation in an already-mounted assembly or its removal from such an assembly for the purpose of carrying out, for example, an inspection or a repair.

In FIG. 8, the wiring diagram of a circuit for controlling the actuating devices of a panel composed of a plurality of modular display devices according to the invention is shown.

The display panel is shown diagrammatically in the rectangle 45 in chain-dotted lines, the modular display devices 30 being materialized with their actuating electromagnets 8 and 18, to which associated electronic control circuits 46 are connected. The control circuit additionally comprises an information control system 47 having, for each module, as many control outputs X as the module has display element columns and as many control outputs Y as the module has display element rows. The control system 47 is connected to a data input keyboard 48, to a display screen 49 and to a magnetic disc or tape store 50, which are intended to introduce into the system the information corresponding to an image to be displayed on the display panel 45.

The circuit is supplied with low d.c. voltage from the mains via a rectifier 51 connected to the control circuit 46 of the various modular display devices.

The device which has just been described operates in the following manner.

This operation is illustrated by using one modular display device, it being understood that the operation of various modular display devices of a panel composed of a plurality of devices of this type is the same.

As indicated above, a modular display device comprises L columns of H display elements each.

Any display element Cij can be located by the rows i and j of the column and of the line to which it belongs.

The display elements can be actuated in terms of rotation with the aid of the following two main members:

1) the supporting shafts 3.

A modular display device comprises H supporting shafts 3 arranged parallel to one another and defining the rows of elements of the device; each shaft 3 carries the L display elements 4 of the same row by passing through their centre.

A shaft 3 is located by the number j of the row to which it belongs The rotation of a shaft 3 tends to simultaneously drive by means of friction the L display elements 4 through which it passes, in terms of rotation.

At rest, the supporting shafts 3 are stationary.

2) the blocking bars 16.

A modular display device comprises L blocking bars 16 arranged according to the columns of the device. A blocking bar 16 is located by the number i of the column to which it belongs.

In the blocked position, corresponding to the position of rest of its actuating electromagnet 18, a blocking bar 16 prevents any rotation of the H display elements 4 of its column. In the released position, shown in FIG. 4, corresponding to an active state of its actuating electromagnet, a blocking bar 16 allows the rotation of the H display elements of its column.

In order to modify the visible face 6 of a display element 4 of coordinates i and j, the following two simultaneous operations are performed.

a) Driving, in terms of rotation, the supporting shaft 3 of row j which passes through the L display elements 4 of ordinates j and which tends to drive them in terms of rotation by means of friction on the action of the means for connecting the elements 4 corresponding with the shaft 3, described with reference to FIGS. 5*a* and 5*b*.

b) Releasing the blocking bar 16 of row i, which allows the rotation of the H cubes of abscissa i. The L-1 blocking bars 16 of rows different from i remain in the blocked position and prevent, in particular, the rotation of the display elements 4 which are situated on the axis j but the abscissae of which are different from i.

The drive shaft 3 driven by its driving electromagnet 8 by means of the pawl 14 and ratchet wheel 15 device, can only rotate in one direction. Consequently, in order to display a display face 6, of specific colour, of the display element 4 which is displaced, it is necessary to rotate the supporting shaft of ordinate j through 1, 2 or 3 quarter turns. The number of quarter turns which have to be performed on the display element 4 is determined by the control device 47 of the control circuit shown in FIG. 8 as a function of the present colour displayed by the element and of the future colour to be displayed.

The positions of all the display elements of the modular display device, as well as of the display elements of the adjacent modular display devices making up an image on a display panel composed of a plurality of modular devices, are stored in a back-up store protected from any power failure or improper handling.

This store is in the control circuit of FIG. 8 and consists of the magnetic disc or tape store 50. When a drive shaft 3 is stationary and all the blocking bars 16 are released, the friction between the branches of the kick-over springs 26 ensuring the connection between each display element 4 and its supporting shaft 3 is sufficient to prevent any accidental rotation of the display elements relative to their supporting shafts under the effect of an external source, for example the wind.

As indicated above, in the absence of a supply to the electromagnets 18 shown in FIGS. 3 and 4, the blocking bars 16 remain in the blocked position owing to the return springs 20, so that the image displayed by the combination of colour of the display elements 4 is preserved in a stable manner.

The passage from one image to another in a modular display device is carried out row by row, by simultaneously rotating all the display elements 4 carried by a supporting shaft 3 and which are not blocked by their corresponding blocking bars 16 as a function of the selection made by the control device 47.

In a display panel such as that shown in FIG. 6, which comprises a plurality of modular display devices 30, the passage from one image to another can be carried out by simultaneously actuating the various modular display devices 30 using the same procedure.

The flow chart shown in FIG. 9 illustrates the management of a modular display device 30 by the control device 47 during the passage from an image displayed by this display device to a different image. The following input variables are required for the implementation of this flow chart:

a matrix of the present or instantaneous state "Aij".

a modular display device 30 is taken to comprise, by way of example, thirty rows of display elements 4 of thirty elements each. Consequently, i is between 1 and 30 and j is also between 1 and 30.

a matrix of the "future" desired state Bij, with i between 1 and 30 and j between 1 and 30.

In view of the fact that the display elements 4 of the device each comprise four faces of different colour, Aij and Bij can have values of 1, 2, 3 or 4.

The parameters of the sequence are as follows:

1) n=number of pulses for controlling the electromagnets 8 for driving the supporting shafts 3, called electromagnet type Y.

2) dwell times t1=excitation time of the electromagnets 8 of the type Y.

t2=idle time of the electromagnets 8 of the type Y.

By way of example, the unit of time is chosen to be equal to 1/100 of a second. Under these conditions, the times t1 and t2 can be between 0 and 99 units of time respectively.

The output variables of the control device are as follows:

Signals for controlling the electromagnets 18 of the type X, Xi, with i=1 to 30.

Signals for controlling the electromagnets 18 of type Y, Yj, with j=1 to 30.

Xi and Yj can take the values 0 or 1.

The software permits the performance of the following functions in any order, according to the operator's preference.

1) acquisition, by means of the keyboard 48 using a cursor on the screen 49 or alternatively with the aid of the magnetic medium consisting of the tape or disc 50, of the data matrix Aij corresponding to the present state of the displayed image.

2) automatic acquisition of the special matrix Aij=1 for every (i, j).

3) editing of the matrix Aij on the magnetic medium 50.

4) initialization of the matrix Bij of the desired future state of the image displayed by taking Bij=Aij.

5) acquisition of the matrix Bij by means of the keyboard 48 or the magnetic medium.

6) possibility of recording a certain number of matrices Bij of desired future images in a matrix library, and of calling them.

7) acquisition of the parameters of the sequence.

8) execution of an automatic display, that is to say controlling the passage of each movable element 4 from the state Aij to the state Bij.

9) execution of a sequence of automatic displays.

10) step-by-step execution of a display for testing.

The flow chart of FIG. 9 shows the phases of one automatic display operation. At the start of the operation j is given the value of 1, which means that first of all the row 1 of display elements 4 carried by the first supporting shaft 3 of the device starting, for example, from the top is considered. During the phase 55, a comparison is made of the present state Aij of the display elements 4 of the first row with the future state Bij to be obtained. It is determined whether Bij=Aij.

If this is so, it means that the future image is identical to the present image and that it is therefore not necessary to modify the position of the display elements 4 of the first row of the device.

It is then possible to proceed to the following row of elements where j=j+1.

If this is not so, proceed to phase 56 making i=1, corresponding to the first display element of the first row, for example from the left of the device, during which it is determined whether Bij−Aij=0.

If this is the case, it means that the first display element of the first row does not need to be modified and we then proceed directly to the examination of the situation of the following element of the row under consideration, where i=i+1.

Where this is not the case, it means that the first display element has to be displaced, in terms of rotation, by 1, 2 or 3 quarter turns according to the colour which it is desired to display.

The supply to the electromagnet 18 of type X is then started up, by making Xi=1, so as to cause the release of the corresponding blocking bar 16.

Then, during the phase 57, where Aij=Aij+1, which updates the value of Aij in anticipation of the rotation through a quarter turn which, in actual fact, will not be carried out until during the phase 60.

Since the phase 57 is able to assign to Aij the value 4+1=5, the phase 58 detects this value and transforms it into Aij=1.

Next, the following display element 4 of the row under consideration is examined, where i=i+1.

During the phase 59, it is determined whether i is≦30.

If this is so, it means that all the elements of row j under consideration have still not been examined and that it is necessary to continue the examination by again proceeding to the interrogation phase Bij−Aij=0.

If the inequality of the phase 59 proves not to be true, it means that the examination phase of the row is ended and we then proceed, during the phase 60, to the operations for displacement of the supporting shaft 3 in terms of rotation, intended to modify the position of the display elements concerned in the row under consideration. This operation is initialized by making k=0, k being less than or equal to the number n of teeth of the wheel, corresponding to a rotation through a quarter turn.

Next, Yj is made equal to 1, corresponding to the control for actuating the electromagnet 8 for driving the shaft 3 of row j in terms of rotation.

After a first dwell time t1, corresponding to the rotation of one tooth of the ratchet wheel 15, Yj is made equal to 0.

After a second dwell time t2, k is made equal to k+1 and it is determined, during the phase 61, whether k is≦n.

If it is, it means that the rotation of the shaft 3 must be continued.

If it is not, the operation for rotating the shaft is ended.

Then, during the phase 62, Xi is made equal to 0 with i=1 to 30, in order to ensure the blocking of all the blocking bars 16 of the device.

The shaft 3 under consideration has then rotated through a quarter turn.

Given that for a modification of the state of one row of display elements it may be necessary to rotate the supporting shaft 3 through a maximum of three quarter turns, thereby ensuring a selective blocking and release of the corresponding elements of the row, the phase 55 is repeated as many times as is necessary.

The operations which have just been described are repeated for all the rows, making successively j=j+1 and determining, during the phase 63, whether j is≦30.

When this inequality proves no longer to be true, the image changing operation has ended.

It will be observed that, with the aid of the flow chart which has just been described, it is possible to modify step by step the state of the display elements carried by all the shafts 3 of the device.

As indicated above, the control device 47 can control the various modular display devices 30 which form a display panel simultaneously, thereby permitting a reduction in the time for passing from one display image on a panel to a following image to the time necessary for the modification of images on one modular display device.

In the exemplary embodiments which have just been described, the display elements 4 are carried by tubular supporting shafts 3.

According to a variant, these supporting shafts may be rendered luminous. To this end, they may be constructed with the aid of transparent tubes driven in terms of rotation, within which a fixed luminous tube, such as for example a fluorescent tube, (occupying the cross-hatched portion of element 3 in FIG. 3) is placed. They may also consist of a sheath containing a bundle of optical fibres made of plastic, one optical fibre emerging at the centre of each display element. In this case, the display elements 4 are made of a translucent material so as to be rendered luminous by the light source formed by their supporting shaft 3.

In the embodiment described with reference to FIGS. 1 to 5*b*, the display elements 4 comprise usable faces 6 of different colour which have a concave configuration so as to leave a minimum clearance between the display elements 4 of two adjacent rows. However, the display elements may have faces of any appropriate form.

The electromagnets 8 and 18 for actuating the drive shafts 3 and the blocking bars 16 are arranged to the rear of the display elements 4 so as not to extend beyond the periphery of the housing of the modular display device, which can then be easily juxtaposed with other identical modular devices.

A modular display device containing H×L display elements 4 comprises H electromagnets 8 for actuating the H supporting shafts 3 and L electromagnets 18 for actuating the L blocking bars 16 of the device.

It can therefore be seen that, by virtue of the arrangement of the invention, it is possible to achieve a considerable saving owing to the reduction in the number of actuating electromagnets, compared with the number of actuating electromagnets equal to the number of elements to be controlled, which is generally necessary in conventional display devices.

The supporting framework or housing 1 of each modular display device is constructed to be sufficiently resistant to permit the stacking of the modular display devices on top of one another up to a height permitting the formation of display panels of very large dimensions.

In an array of juxtaposed modular devices, it is possible, by virtue of the connecting means between the modules described with reference to FIG. 6, to remove any modular device in order to carry out maintenance, without affecting the other modules or damaging the stability of the array.

In a preferred exemplary embodiment of the invention, each modular display device comprises 900 display elements 4 arranged in thirty rows of 30 elements each. A modular display device thus formed is of reasonable weight and dimensions and can therefore be handled easily during its installation or removal.

It comprises, in fact, only 60 electromagnets for actuating 30 element supporting shafts 3 and 30 blocking bars 16.

In the embodiment described with reference to FIG. 1, a modular display device comprises supporting shafts 3 arranged horizontally and blocking bars 16 arranged vertically.

Of course, this device can also be designed with vertical display element support shafts and horizontal blocking bars.

Although it is possible in a display panel consisting of a plurality of modular display devices for the display devices to be controlled simultaneously, it is advantageous to perform this control in a slightly staggered manner so as to prevent excessive instantaneous power consumption.

The device which has just been described can be used to form display panels either in the open air or inside premises. It is particularly advantageous when the information which it displays is modified with a frequency of between 10 mn and one day. It is well suited to display information in places visited by a large number of people, such as exhibitions, conference halls, large sports meetings, airports, amusement parks and the like.

It is particularly well suited to display advertisements.

On account of the large dimensions which can be attained by a display panel produced with modular display devices according to the invention, it is possible to put such a panel in places far away from public thoroughfares, on supports which are not generally utilized by traditional displays, and thus to benefit from renting spaces at moderate cost.

The display devices according to the invention additionally have the advantage that they can be placed outside directly without a protective transparent wall and thus have excellent visibility without undesired reflection, even when viewed from the side.

Although in the examples of the invention described above the devices for actuating the display element supporting shafts 3 and the bars 16 for blocking the said elements comprise electromagnetic actuators or electromagnets 8, 18, these actuators may also be of the electropneumatic type.

I claim:

1. A display device, comprising:

an array of rotatable display elements, each display element having at least two faces of different color, the display elements being arranged in rows and columns;

first and second means for determining rotation of the rotatable elements to change which face of each rotating element is displayed by the display device;

means for controlling the first and second means for determining rotation, so as to form an image to be displayed by the display device;

at least one common shaft on which the rotatable display elements of each row or column rotate, the common shaft mounted in a frame of the display device;

friction couplings for connecting respective rotating elements to one of the common shafts; and retractable members for inhibiting rotation of all rotating elements of respective columns or rows;

wherein each first means for determining rotation includes only one device for rotating in a step-by-step manner each common shaft; and wherein each second means for determining rotation corresponds to only one retractable member.

2. The display device of claim 1, wherein the device for rotating each shaft includes:

an electromagnetic or electropneumatic actuator mounted on a wall of the device;

a rod translated by the actuator;

an arm articulated to the end of the rod;

a pawl carried by the arm;

a ratchet wheel fixed to a corresponding shaft and cooperating with the pawl; and elastic means for returning the rod and the pawl after one driving stroke of the actuator so that the pawl engages a following tooth of the ratchet wheel;

wherein the travel of the actuator corresponds to an angular displacement of a tooth of the ratchet wheel.

3. The display device according to claim 2, wherein:

the number of teeth on the ratchet wheel is equal to an integral multiple of the number of faces on the display elements.

4. The display device according to claim 1, wherein:

each display element includes a molded part having (1) an outer lateral surface defining the display faces of the display element and (2) a hub for mounting the element on its supporting shaft;

the friction coupling between the display element and the shaft is divided by an elastic element which grips the supporting shaft or bears thereon and which rotates the display element when the display element is free to rotate by bearing on an inner wall of the display element.

5. The display device of claim 1, wherein:

the retractable member includes a bar translatable between (1) a blocking position in which it is in contact with faces of the display elements opposite the visible faces of the display element, and (2) a release position permitting rotation of the display elements under the action of the rotation of their supporting shaft; and the second means for determining rotation of the rotatable elements includes an electromagnetic or electropneumatic actuator for displacing the bar, acting against a means for elastically returning the bar to the blocking position.

6. The display device of claim 1, wherein:

the shafts for supporting the display elements include tubular shafts made of translucent or transparent material; and at least one illumination source is fitted in each shaft for illuminating corresponding display elements.

7. The display device of claim 1, further comprising:

means for removably joining together adjacent modular display devices so as to allow the display devices to form a display panel of desired dimensions.

8. The display device of claim 7, wherein the means for removably joining together includes:

an externally threaded annular part screwed into one wall of the device and including a cylindrical portion and a frustoconical end adapted for engagement in a seating formed in one wall of an adjacent modular display device, the length of the cylindrical portion of the annular part being greater than the thickness of the wall of the display device in which it is mounted, so as to form a clearance between the facing walls of two adjacent modular display devices; and a screw passing through a bore in the annular part and engaged in a threaded hole coaxial with the bore and provided in the wall of the adjacent modular display device.

9. The display device of claim 1, wherein:

the means for controlling includes a control circuit associated with which are a keyboard, a screen, and a magnetic disk or tape storage device; and the control circuit has, for each of the modular display devices:

(1) first outputs for controlling first electromagnets, for actuating bars of the retractable members for inhibiting the rotation of the display elements; and (2) second outputs for controlling second electromagnets, for rotating the shafts supporting the display elements.

10. The display device of claim 1, wherein:

the display elements have a cross-section in the form of an equilateral triangle; and the bars for inhibiting rotation of the display elements each have notches adapted to receive vertices of the equilateral triangle of the display elements, the vertices being situated opposite the faces of the display elements appearing on the display.

11. The display panel of claim 2, wherein:

the shafts for supporting the display elements include tubular shafts made of translucent or transparent material; and at least one illumination source is fitted in each shaft for illuminating corresponding display elements.

12. The display panel of claim 3, wherein:

the shafts for supporting the display elements include tubular shafts made of translucent or transparent material; and at least one illumination source is fitted in each shaft for illuminating corresponding display elements.

13. The display panel of claim 4, wherein:

the shafts for supporting the display elements include tubular shafts made of translucent or transparent material; and at least one illumination source is fitted in each shaft for illuminating corresponding display elements.

14. The display panel of claim 4, wherein:

the shafts for supporting the display elements include tubular shafts made of translucent or transparent material; and at least one illumination source is fitted in each shaft for illuminating corresponding display elements.

15. A display panel comprising a plurality of modular display devices joined together, each modular display device including:

an array of rotatable display elements, each display element having at least two faces of different color, the display elements being arranged in rows and columns;

first and second means for determining rotation of the rotatable elements to change which face of each rotating element is displayed by the display device;

means for controlling the first and second means for determining rotation, so as to form an image to be displayed by the display device;

at least one common shaft on which the rotatable display elements of each row or column rotate, the common shaft mounted in a frame of the display device;

friction couplings for connecting respective rotating elements to one of the common shafts; and retractable members for inhibiting rotation of all rotating elements of respective columns or rows;

wherein each first means for determining rotation includes only one device for rotating in a step-by-step manner each common shaft; and wherein each second means for determining rotation corresponds to only one retractable member.

16. The display panel of claim 15, further comprising:

a control circuit associated with which are a keyboard, a screen, and a magnetic disk or tape storage device, the control circuit having, for each of the modular display devices:

(1) first outputs for controlling first electromagnets, for actuating bars of the retractable members for inhibiting the rotation of the display elements; and (2) second outputs for controlling second electromagnets, for rotating the shafts supporting the display elements.

* * * * *